United States Patent [19]

Pitzel

[11] 4,138,744

[45] Feb. 13, 1979

[54] REVERSIBLE, MULTI PURPOSE, MULTI STYLABLE STRUCTURE

[76] Inventor: Michael A. Pitzel, 5333 Baltimore Dr. #16, La Mesa, Calif. 92041

[21] Appl. No.: 848,430

[22] Filed: Nov. 4, 1977

[51] Int. Cl.[2] ..... A42B 1/00; A42C 1/00

[52] U.S. Cl. ..... 2/192; 2/171; 2/209.1; 2/175; 2/91; 46/1 L

[58] Field of Search ..... 2/171, 172, 202, 204, 2/207, 208, 209.1, 196, 175, 192, 198, 177, 174, 91; 46/1 L, 1 F; 93/84 R, 86

[56] References Cited

U.S. PATENT DOCUMENTS

| | | | |
|---|---|---|---|
| 1,299,329 | 4/1919 | Griffith | 2/209.3 |
| 2,112,774 | 3/1938 | Thorman | 2/198 X |
| 2,154,059 | 4/1939 | Alexander | 2/198 X |
| 2,673,350 | 3/1954 | Chuck | 2/177 |
| 3,105,970 | 10/1963 | Herzberg | 2/207 X |
| 3,187,345 | 6/1965 | Holford | 2/209.1 |
| 3,213,466 | 10/1965 | Gettinger | 2/198 |

FOREIGN PATENT DOCUMENTS

| | | | |
|---|---|---|---|
| 1003368 | 3/1952 | France | 2/198 |
| 479734 | 6/1950 | Italy | 2/192 |

*Primary Examiner*—Werner H. Schroeder
*Assistant Examiner*—Andrew M. Falik
*Attorney, Agent, or Firm*—Henderson, Sturm, Cepican & Fix

[57] ABSTRACT

A reversible, multi purpose, multi stylable structure for use as a hat, a pouch, a muff and a puppet, and formed from a multicolored equilateral triangle which is folded and secured in a position which permits the folded structure to be turned inside out to present six different combinations of outer surfaces, and including the method of constructing same.

22 Claims, 44 Drawing Figures

REVERSIBLE, MULTI PURPOSE, MULTI STYLABLE STRUCTURE

BACKGROUND OF THE INVENTION

This invention generally relates to a hat and more particularly to a structure which is not only reversible to present at least six different hats, but is capable of being shaped into a plurality of different styles which can be utilized as a hat, a puppet, a purse, a pocketbook, a muff or the like and which is adapted to sports or dress attire.

Style and color are major factors in the purchase of many items of a wardrobe and with few exceptions, most people acquire hats, caps and purses of many colors and styles to provide color and for style coordinated outfits. Large wardrobes thus are acquired at considerable cost and require considerable space for storage. In addition, the large wardrobe does not lend itself to an extremely mobile, vacation minded public.

A reversible hat has been developed, such as that disclosed in U.S. Pat. No. 3,187,345, wherein the hat can be turned inside out and also can be styled in a number of ways; however, only two different basic hats are disclosed as to color combinations. Therefore, it is limited in its use by the color restriction.

The structure of the present invention is designed to provide multi-colors and multi-shapes and therefore overcomes the disadvantage depicted above.

SUMMARY OF THE INVENTION

It is an object of this invention to provide a reversible-multi-purpose-multistylable hat for use as a hat, a cap, a muff, a pouch, a purse, a pocketbook or the like.

Another object of this invention is the provision of a structure which can be turned within itself a plurality of times to present six different outer surfaces, thus providing six totally different colorable exteriors.

A further object of this invention is to provide a multi-stylable structure wherein it can be changed to resemble a turban, a dunce cap, a sorceror's cap, a wizard's cap, an elf's cap, a pixie's cap, a jestor's cap, a ski cap, a stocking cap or the like.

Still another object of the invention is to provide a hat that can cover the ears; can shade the head from the sun; protect the head from the cold, the rain, the snow, or the hail; which can be folded or rolled up, which can be stuffed in a pocket like a stocking cap; and which has a pocket therein to conceal items, to carry items and to protect items.

Yet another object of this invention is the provision of a multi-purpose, multi-style, multi-color hat which is simple and economical of manufacture, extremely effective in use, simple of design and rugged in construction.

These and other objects of the invention are accomplished by providing a hat formed from a piece of material, equilateral in shape, which upon being folded and sewn provides a six walled 30° - 60° - 90°, triangular shaped hat, that can be shaped into a plurality of different designs and which can be turned or folded within itself to provide different outer walls.

BRIEF DESCRIPTION OF THE DRAWINGS

The advantages of this invention will become apparent upon consideration of the following detailed disclosure of the invention, especially when taken in conjunction with the accompanying drawings wherein.

DESCRIPTION OF THE PREFERRED EMBODIMENT

Figure 1:
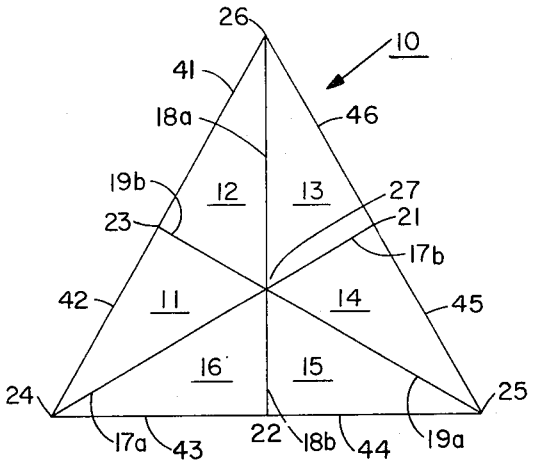
FIG. 1 is a plan view of the blank from which the pouch of this invention is formed.
Figure 2:
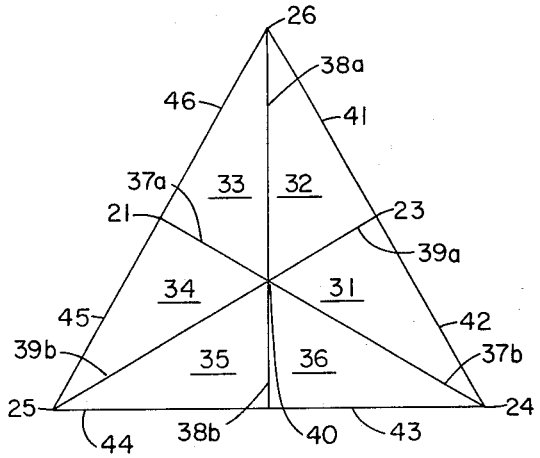
FIG. 2 is a plan view of the opposite side of the blank.

Referring now to the drawings and particularly to FIG. 1 the reversible, multi-purpose pouch is depicted in its blank form 10 as an equilateral triangle which is formed from cloth or the like. The blank is divided into six equal 30° - 60° - 90° triangles 11–16 by drawing lines 17, 18 and 19 from the midpoint 21–23 of each edge to the point 24, 25 and 26 opposite that edge respectively. It will be noted that each of the above lines 17, 18 and 19 intersect at a point 27 thus dividing each line into an "a" and a "b" section. The opposite side of the blank 10 (FIG. 2) is also divided into six equal 30° - 60° - 90° triangles 31–36 by drawing lines 37, 38 and 39 from the midpoint of each edge to the point 24, 25 and 26 opposite that edge respectively. The lines 37, 38 and 39 will intersect at point 40 and are further identified by an "a" and "b" designation.

For the purpose of later identification, the peripheral edge of the blank is identified as follows: the edge extending between points 26 and 23 is designated as 41, between points 23 and 24 as 42, between points 24 and 22 as 43; between points 25 and 22 as 44, between points 21 and 25 as 45; and between points 26 and 21 as 46.

The blank 10 is first folded along line 18 with point 25 juxtaposed on point 24 (FIG. 3) thus forming a 30° - 60° -90° triangle. The next or second fold is along line **39*b* in FIG. 3 wherein midpoint 22, now a point, is placed in juxtaposition on midpoints 21 and 23, thus forming a 30° - 30° -120° triangle (FIG. 4**).

Figure 4:
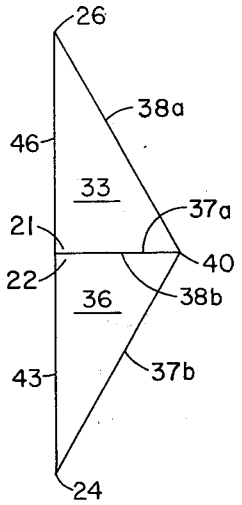
FIG. 4 is a plan view of the blank after a second fold.
Figure 5:
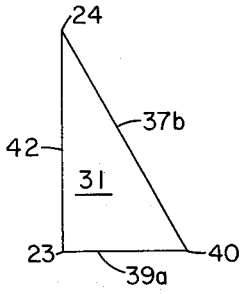
FIG. 5 is a plan view of the blank after a third and final fold.
Figure 6:
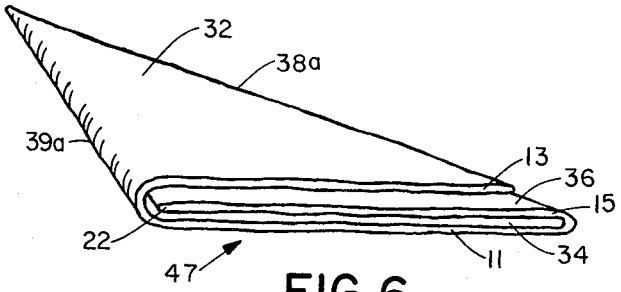
FIG. 6 is an enlarged perspective view of the structure of FIG. 5 showing one edge thereof in open position.
Figure 7:
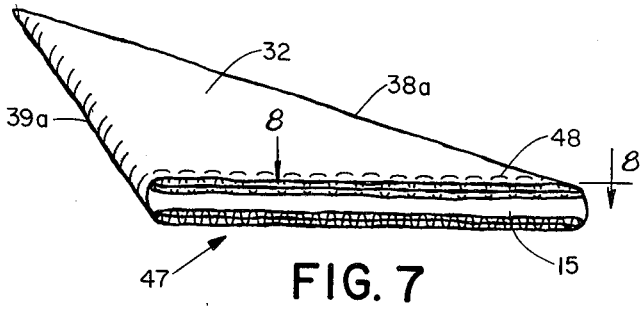
FIG. 7 is a perspective view similar to FIG. 6, but with the edges sewn together.
Figure 8:
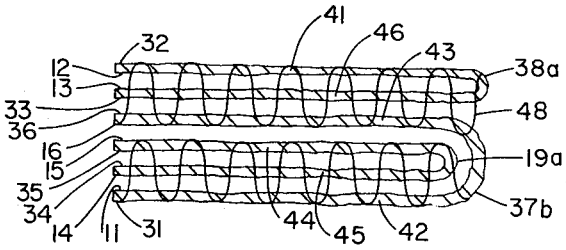
FIG. 8 is a partial enlarged sectional view taken along the lines 8—8 in FIG. 7.
Figure 9:
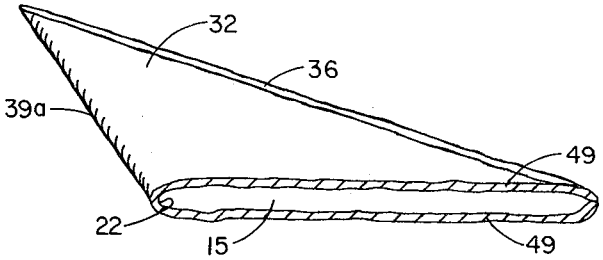
FIG. 9 is a perspective view similar to FIG. 7 wherein tape is used to cover the edges.

The structure of FIG. 4 is then folded along line **37*a* with point 24 in juxtaposition with point 26, and with triangle 31 in plan view (FIG. 5) thus forming a 30° - 60° - 90° triangle. Reference to FIG. 6 will disclose that the open edge, line 47, includes six edges. These six edges are divided into two groups of three edges each. Each group is affixed or sewn together (FIGS. 7 and 8) by thread 48 alone, or a tape 49 and thread 48 is used thus presenting a neat and even appearance (FIG. 9) thereby covering all of the peripheral edges of the original blank 10. As viewed in FIG. 9, the tape 49, from point 22, is continuous and extends completely around the periphery of the open edge, line 47**.

Figures 10, 11, 12, 13, 14, 15, 16, 17, 18, 19, 20, 21:
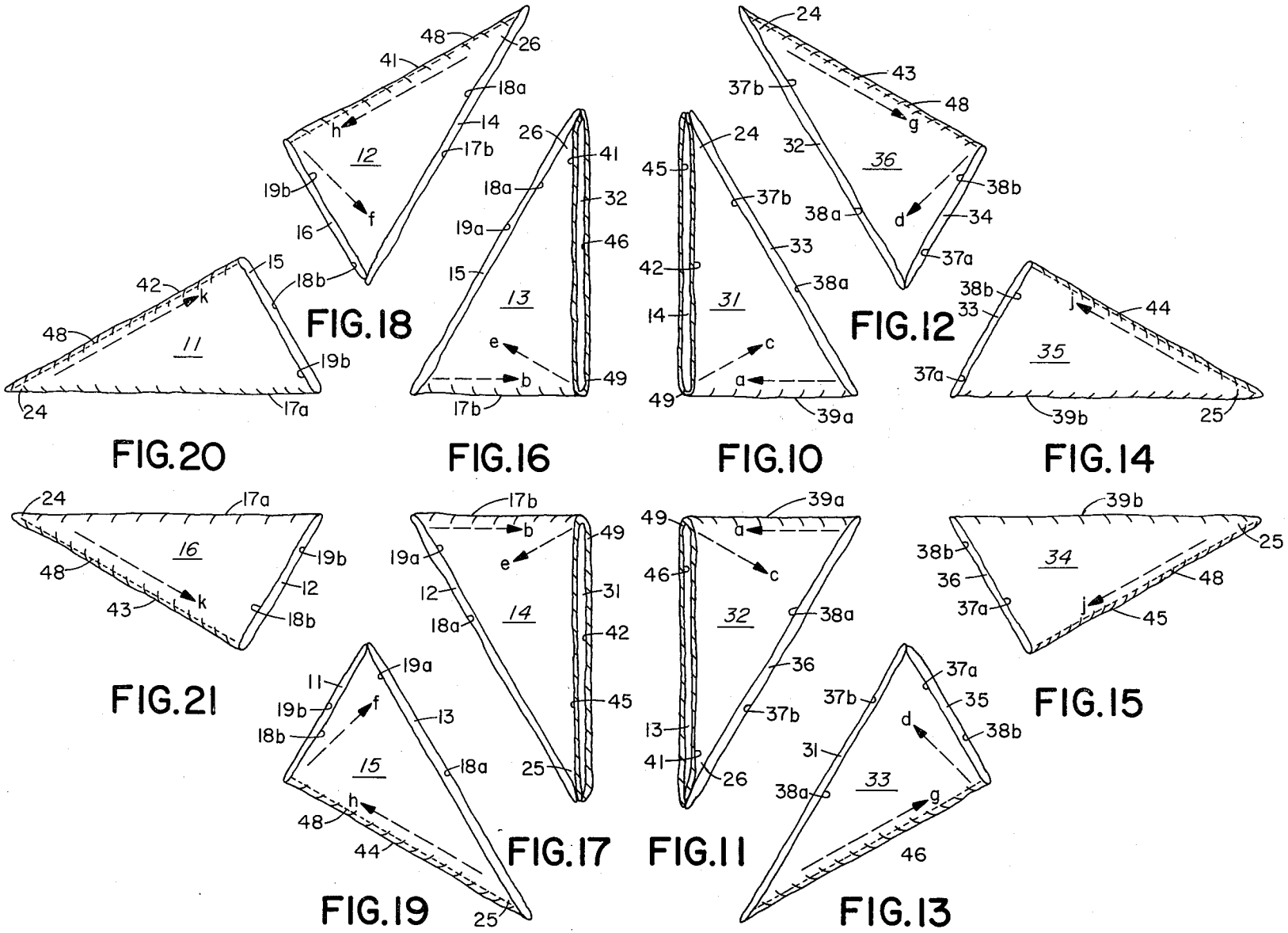
FIG. 10 is a top plan view in a first position.
FIG. 11 is a bottom plan view thereof.
FIG. 12 is a top plan view in a second position.
FIG. 13 is a bottom plan view thereof.
FIG. 14 is a top plan view in a third position.
FIG. 15 is a bottom plan view thereof.
FIG. 16 is a top plan view in a fourth position.
FIG. 17 is a bottom plan view thereof.
FIG. 18 is a top plan view in a fifth position.
FIG. 19 is a bottom plan view thereof.
FIG. 20 is a top plan view in a sixth position.
FIG. 21 is a bottom plan view thereof.

Referring next to FIGS. 10–21 there is shown the six different models which can be formed from the structure. In FIGS. 10 and 11, the hat is depicted with triangles 31 and 32 on the outer surface. Triangles 33 and 36 form a pocket between edges **37*b* and 38*a* and triangles 13 and 14 form a pocket between edges 45 and 46**.

Figure 22:
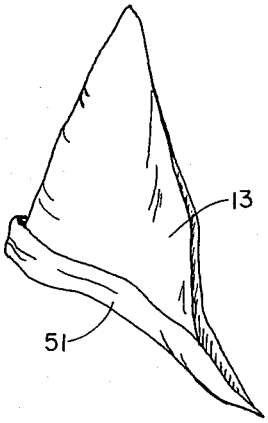
FIGS. 22 through 27 illustrate various models of the hat.
Figure 23:
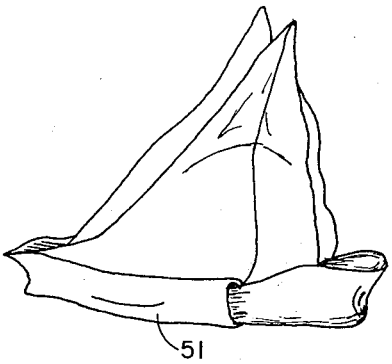

The hat of FIGS. 16 and 17 is identical in shape to the hat of FIGS. 10 and 11 except that the exposed surfaces are represented by triangles 13 and 14 and the pockets are formed by triangles 31 and 32 between the edges 42 and 41, and by triangles 12 and 15 between the edges **18*a* and 19*a*. Two of the hat designs resulting from the shapes found in FIGS. 10, 11, 16 and 17 are found in FIGS. 22 and 23. The edges adjacent the pockets are turned up to form a brim 51 and thus resemble an elf's hat and a pixie hat. By providing a different color arrangement on each of the four exposed surfaces or triangles 13, 14, 31 and 32 two completely different color hats are provided. It will be noted that the FIGS. 16 and 17 hat is formed by merely reaching into the pocket formed by triangle 13 and 14 in FIGS. 10 and 11 and grasping the triangles at their apex and turning the hat inside out by pulling the apexes in the direction of arrow a. The reverse is true if the apexes of the pocket formed by triangles 32 and 31 are pulled in the direction of arrow b to turn the hat of FIG. 16 into the hat of FIG. 10**.

A further reversing of the hat of either FIG. 10 and FIG. 16 by pulling on the apexes in the direction of arrow c and e will result in the hats of FIG. 12 and FIG. 18. The reverse from the above denoted by arrows d and f is also possible. The hat of FIGS. 12 and 13 is formed with triangles 36 and 33 exposed and two pockets are provided; the first pocket is formed by triangles 31 and 32 between the edges **37*b* and 38*a* and the second pocket is formed by triangles 34 and 35 between edges 37*a* and 38*b*. The hat of FIGS. 18 and 19 has triangles 12 and 15 as its two exposed surfaces and its two pockets are defined by triangles 13 and 14 between edges 18*a* and 19*a* and triangles 11 and 16 between edges 19*b* and 18*b***.

Figure 25:
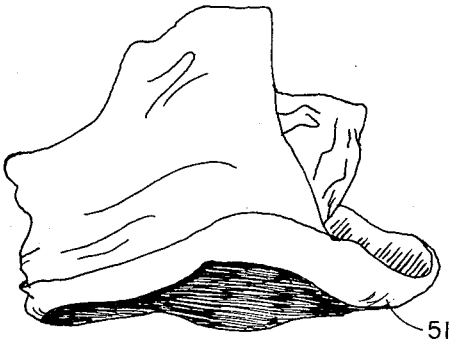
Figure 24:
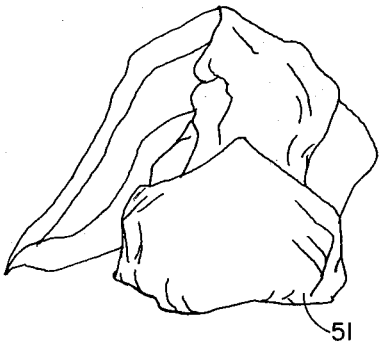

A modified dunce cap or turban is the result of the FIGS. 12 and 18 hat (FIGS. 24 and 25). Again the turning of the edges will form brims 51 and thus at least four different shapes result. A reversing or turning inside out of the hats of FIGS. 12 and 18 via the pockets opening on the short side of each in the direction of arrows g and h results in the hats of FIGS. 14 and 20 respectively; and the reverse, as shown by arrows j and k, is also possible.

Figure 26:
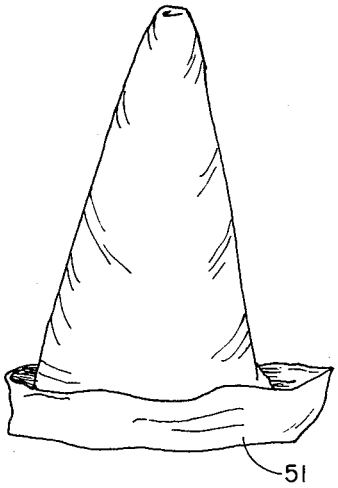
Figure 27:
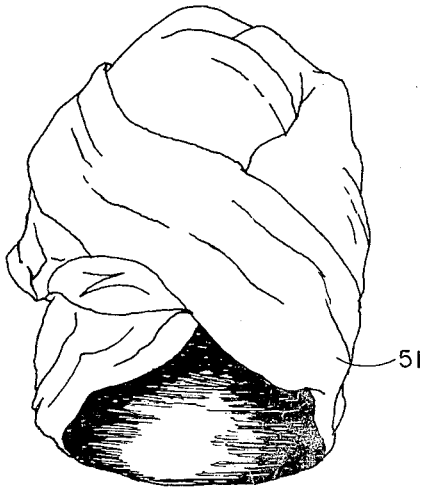

A dunce cap (FIG. 26) or modified turban (FIG. 27) is formed from the hats of FIGS. 14 or 20. The hat of FIG. 14 has triangles 35 and 34 exposed and the hat of FIG. 20 has triangles 11 and 16 exposed. These two hats have only one pocket or opening formed therein, which opening is formed in the first case by triangles 33 and 36 between edges **37*a* and 38*b* (FIGS. 14 and 15) and in the second case by triangles 12 and 15 between edges 18*b* and 19*b***.

Any number of modifications of the hats can be made from the hats disclosed in FIGS. 22–27 by providing no brim, a partial brim or a large brim, by not permitting the apex of any design to project fully away from the pocket engaging the head or by wrapping or permitting the apex to depend from its normal outwardly projecting position. The various color combinations can be expanded by providing a multi-colored liner, in effect depicted by FIG. 2, which can be affixed to the blank of FIG. 1 wherein the blank outer surface is also multi-colored.

Figure 3:
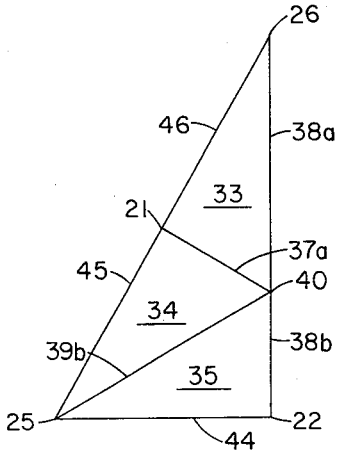
FIG. 3 is a plan view of the blank after a first fold.
Figure 28:
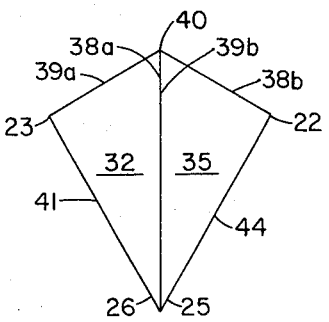
FIG. 28 is a plan view of a modified embodiment of the blank of FIGS. 1 and 2 after a second fold.
Figure 29:
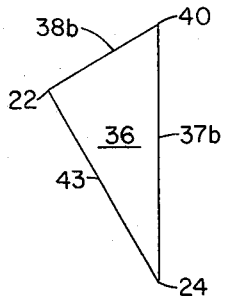
FIG. 29 is a plan view of the blank of FIG. 28 after a third fold.
Figure 44:
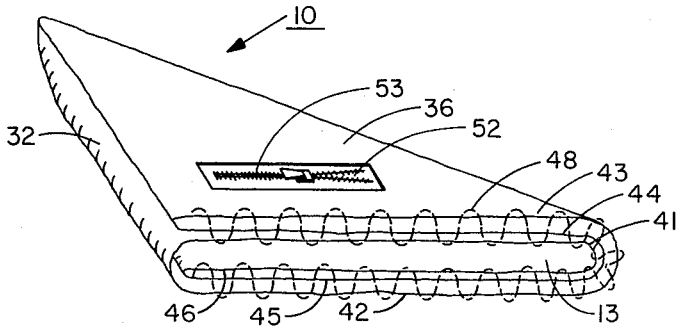
FIG. 44 is a perspective view of the blank of FIG. 29 showing the edges affixed together.

A modified embodiment of the reversible, multi-purpose hat-pouch is depicted in FIGS. 28 through 41 and it is obtained by folding the blank of FIG. 3 in a manner which is different than previously described. Referring to FIGS. 3, 28 and 29, it will be noted that the blank is folded along line **37*a* to form a kite shaped figure (FIG. 28) with triangles 32 and 35 exposed in side to side relation. Triangle 35 is then folded over triangle 32 along line 39*b* to provide the structure of FIG. 29. Again there will be five edges lying under edge 43 (FIG. 44) which edges in descending order will be 44, 41, 46, 45 and 42. The edges are divided into two groups of three each and each group is affixed together and if desired, taped as provided hereinabove. Th different models formed from the structure are depicted in FIGS. 30 through 41**.

Figures 30, 31, 32, 33, 34, 35, 36, 37, 38, 39, 40, 41:
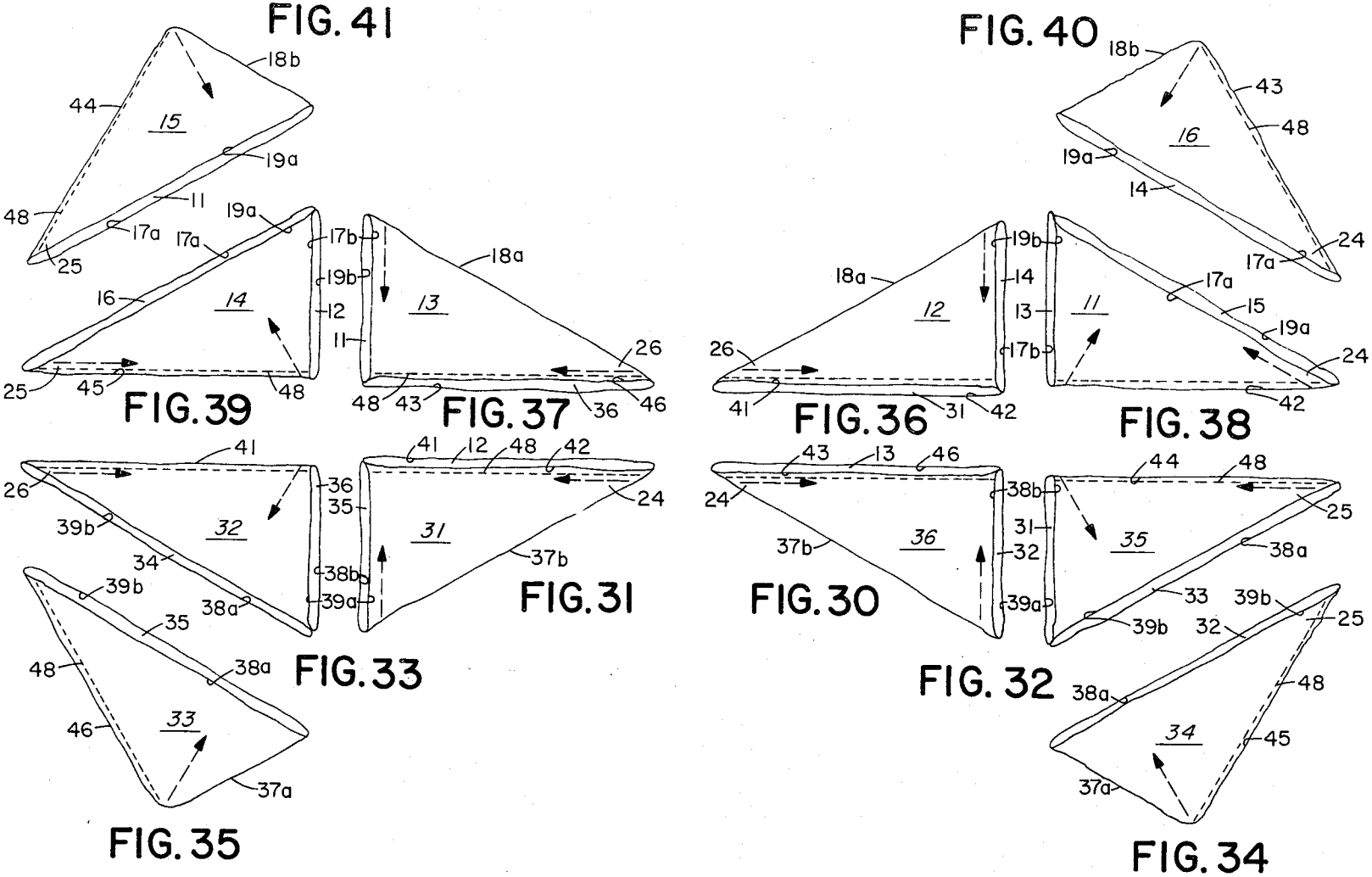
FIG. 30 is a top plan view thereof in a first position.
FIG. 31 is a bottom plan view thereof.
FIG. 32 is a top plan view thereof in a second position.
FIG. 33 is a bottom plan view thereof.
FIG. 34 is a top plan view thereof in a third position.
FIG. 35 is a bottom plan view thereof.
FIG. 36 is a top plan view thereof in a fourth position.
FIG. 37 is a bottom plan view thereof.
FIG. 38 is a top plan view thereof in a fifth position.
FIG. 39 is a bottom plan view thereof.
FIG. 40 is a top plan view thereof in a sixth position.
FIG. 41 is a bottom plan view thereof.

In FIGS. 30 and 31, the hat is shown with the outer surface composed of triangles 36 and 31. Triangles 12 and 13 form a pocket between edges 41 and 46 and triangles 32 and 35 form a pocket between edges **38*b* and 39*b*. The hats of FIGS. 32 and 33 and FIGS. 38 and 39 are identical in shape except that the outer surfaces are represented by different triangles. It will also be observed that the hats of FIGS. 36 and 37 and FIGS. 30 and 31 are identical in shape and again the outer surfaces are represented by different triangles. In FIGS. 32 and 33 the outer surfaces are represented by triangles 32 and 35 with the triangle 31 and 36 forming a pocket between edges 39*a* and 38*b* and the triangles 33 and 34 forming a pocket between edges 38*a* and 39*b*. The hat of FIGS. 36 and 37 have as its outer surface, the triangles 12 and 13 with pockets formed by triangles 31 and 36 between edges 42 and 43, and triangles 11 and 14 between edges 19*b* and 17*b*. The triangles 11 and 14 are the outer surfaces of the hat of FIGS. 38 and 39 and pockets are formed by triangles 13 and 12 between edges 17*b* and 19*b* and triangles 15 and 16 between edges 19*a* and 17*a*. The hats of FIGS. 34 and 35 and FIGS. 40 and 41 are identical in shape and with outer surfaces represented by different triangles. It will be noted that the hat of FIGS. 34 and 35 has outer surfaces formed by triangles 33 and 34 and a pocket formed by triangles 32 and 35 between edges 38***a* and 39*b*, and the hats of FIGS. 40 and 41 has outer surfaces represented by triangles 16 and 15 and pockets provided by triangles 11 and 14 between edges 17*a* and 19*a*.

The arrows depicted in broken line in each of FIGS. 30 through 41 indicate the direction of pull of the apexes to reverse or turn inside out any of the hats. It will be noted that only the hats of FIGS. 34 and 35 and FIGS. 40 and 41 are reversible in only one direction. The hats formed from any of the shapes in FIGS. 30 through 41 substantially resemble the models shown in FIGS. 22 through 27.

Figure 42:
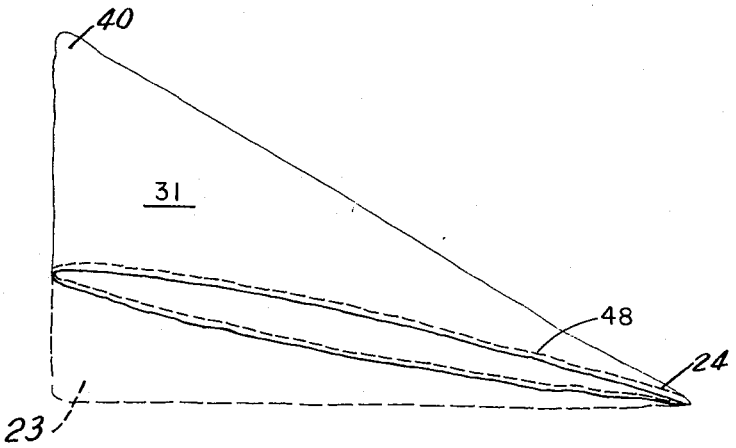
FIG. 42 is an enlarged top plan view of the blank of FIGS. 5 or 29 wherein a portion thereof is removed.
Figure 43:
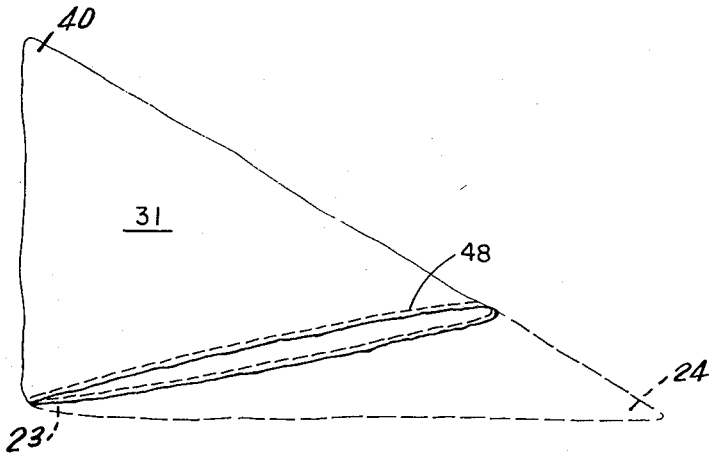
FIG. 43 is a similar view with a different portion thereof removed.

In FIGS. 42 and 43 a portion of the blank is cut-off before the sewing or affixing together of the two groups of edges to provide a second and third modified embodiment of the reversible multipurpose hat. It will be noted that the portion of the blank cut off is an equal portion of each triangle and that equal portion is disposed adjacent the six open edges. Although the embodiments have shown the edges affixed together, a zipper or zippers could be utilized to secure each group together; thus providing additional pockets which are easily reached from the outside of the hat.

Where a liner is utilized an opening 52 or the like may be provided in any or all the triangles in either the blank 10 or the liner, and a zipper 53 or other openable unit may be affixed to provide a closure element therefore. The opening 52 provides access to a pocket between the liner and the blank.

It will be understood that various changes in the colors, the materials, the modification of any of the designs which have been described and illustrated in order to explain the nature of the invention, will occur to and may be made by those skilled in the art upon a reading of the disclosure within the principles and scope of the invention.

I claim:

1. A method for constructing a reversible, multi purpose, multi stylable structure for use as a hat, a pouch, a muff, and a puppet from an equilateral triagle blank having three edges, the method comprising:

(a) divide the equilateral blank into six equal 30°-60°-90° triangles by drawing lines from the midpoint of each edge to the angle opposite thereof;

(b) fold the equilateral blank over upon itself with three of the 30°-60°-90° triangles juxtaposed on the other three 30°-60°-90° triangles to provide a folded first blank;

(c) fold the first blank over upon itself with two of the juxtaposed triangles juxtaposed on two adjacent juxtaposed triangles thus providing a folded second blank with four juxtaposed triangles disposed adjacent two juxtaposed triangles;

(d) fold the second blank over upon itself with the four juxtaposed triangles disposed under the two juxtaposed triangles thus providing a folded third blank with six juxtaposed triangles wherein one of the sides thereof is open and provides six edges;

(e) separate the six edges into two groups of three edges each; and (f) affix the three edges in each group together thus providing the third blank with a pocket.

2. A method of constructing a reversible, multi purpose, multi stylable structure as defined in claim 1 and including the turning up of the edges adjacent the pocket to form a brim.

3. A method of constructing a reversible, multi purpose, multi stylable structure as defined in claim 1 including the inward positioning of the apex of any triangle opposite a pocket.

4. A method of constructing a reversible, multi purpose, multi stylable structure as defined in claim 3 and including the turning up of the edges adjacent the pocket to form a brim.

5. A method of constructing a reversible, multi purpose, multi stylable structure as defined in claim 1 and including, prior to the step of affixing three edges of each group together, the step of cutting off equal portions of each triangle disposed adjacent the six open edges.

6. A method of constructing a reversible, multi purpose, multi stylable structure as defined in claim 5 and including the inward positioning of the apex of any triangle opposite a pocket.

7. A method of constructing a reversible, multi purpose, multi stylable structure as defined in claim 6 and including the turning up of the edges adjacent the pocket to form a brim.

8. A method of constructing a reversible, multi purpose, multi stylable structure as defined in claim 1 and including the affixing of a tape over the three edges of each group.

9. A method of constructing a reversible, multi purpose, multi stylable structure as defined in claim 8 and including prior to the step of affixing three edges of each group together, the step of cutting off equal portions of each triangle disposed adjacent the six open edges.

10. A method of constructing a reversible, multi purpose, multi stylable structure as defined in claim 9 and including the inward positioning of the apex of any triangle opposite a pocket.

11. A method of constructing a reversible, multi purpose, multi stylable structure as defined in claim 10 and including the turning up of the edges adajcent the pocket to form a brim.

12. A method of constructing a reversible, multi purpose, multi stylable structure as defined in claim 1 and including prior to the first folding the affixing of a liner to one side of the blank.

13. A method of constructing a reversible, multi purpose, multi stylable structure as defined in claim 9 and including prior to the step of affixing three edges of each group together, the step of cutting off equal portions of each triangle disposed adjacent the six open edges.

14. A method of constructing a reversible, multi purpose, multi stylable structure as defined in claim 10 and including the inward positioning of the apex of any triangle opposite a pocket.

15. A method of constructing a reversible, multi purpose, multi stylable structure as defined in claim 11 and including the turning up of the edges adjacent the pocket to form a brim.

16. A reversible, multi purpose, multi stylable structure for use as a hat, a pouch, a muff and a puppet comprising:

an equilateral triangle divided into six equal triangles and folded over upon itself three times to dispose said triangles in a stack, with a side of the stack open and having six edges, with the six edges divided into two groups of three edges each and with the edges of each group affixed together, the structure thus providing at least one pocket between the outer triangles which pocket opens toward the edge; said structure being reversible upon itself by turning each pocket inside out thus making inner triangles the outer triangles.

17. A reversible, multi purpose, multi stylable structure as defined in claim 16 and including the affixing of tape over the open edges of each group.

18. A reversible multi purpose, multi stylable structure as defined in claim 18 and including an equilateral triangle liner affixed to said blank.

19. A reversible, multi purpose, multi stylable structure as defined in claim 18 wherein said blank and said liner are each multicolor.

20. A reversible, multi purpose, multi stylable structure as defined in claim 17 wherein said edges of each group are affixed together by openable means.

21. A reversible, multi purpose, multi stylable structure as defined in claim 18 wherein said openable means is a zipper.

22. A reversible, multi purpose, multi stylable structure as defined in claim 18 and including at least one opening formed in said blank and at least one openable means secured to said blank proximate each said opening for opening and closing said opening.

* * * * *

UNITED STATES PATENT AND TRADEMARK OFFICE

CERTIFICATE OF CORRECTION

PATENT NO. : 4,138,744

DATED : February 13, 1979

INVENTOR(S) : Michael A. Pitzel

It is certified that error appears in the above-identified patent and that said Letters Patent are hereby corrected as shown below:

Column 4, line 44

"Th" change to --The--

Column 7, line 14

"18" change to --17--

Signed and Sealed this

*Fifth* Day of *June 1979*

[SEAL]

*Attest:*

RUTH C. MASON
*Attesting Officer*

DONALD W. BANNER
*Commissioner of Patents and Trademarks*